US005610381A

United States Patent [19]

Mizufune et al.

[11] Patent Number: 5,610,381

[45] Date of Patent: Mar. 11, 1997

[54] COMPRESSION GAS PUFFER TYPE CIRCUIT BREAKER

[75] Inventors: Eisaku Mizufune; Kenichi Natsui; Yukio Kurosawa; Goro Daimon; Yoshihito Asai, all of Hitachi; Katsuichi Kashimura, Takahagi; Osamu Koyanagi, Hitachi; Kogi Ishikawa, Mito, all of Japan

[73] Assignee: Hitachi, Ltd., Tokyo, Japan

[21] Appl. No.: 553,754

[22] Filed: Oct. 23, 1995

[30] Foreign Application Priority Data

Oct. 28, 1994 [JP] Japan ..... 6-264840

[51] Int. Cl.[6] ..... H01H 33/88

[52] U.S. Cl. ..... 218/57; 218/59; 218/65

[58] Field of Search ..... 218/57–67, 1, 218/68–88, 29

[56] References Cited

U.S. PATENT DOCUMENTS 4,052,577 10/1944 Votta ..... 218/29

4,409,447 10/1983 Noeske ..... 218/57

4,431,886 2/1984 Logan ..... 218/1

*Primary Examiner*—J. R. Scott

*Attorney, Agent, or Firm*—Fay, Sharpe, Beall, Fagan, Minnich & McKee

[57] ABSTRACT

A compression gas puffer type circuit breaker has a magnetic body surrounding a conductor between a stationary arc contact and a main bus conductor. The magnetic body is protected from being exposed to heated puffer gas generated when a movable arc contact is separated from the stationary arc contact by disposing an insulator partition plate supporting the conductor at the downstream end of a cylindrical contact base carrying a main stationary contact and upstream of the magnetic body. Conductors are disposed around the magnetic body so as to increase flux linkage with the magnetic body when an arcing current flows through the conductor during a circuit breaking operation.

9 Claims, 4 Drawing Sheets

COMPRESSION GAS PUFFER TYPE CIRCUIT BREAKER

BACKGROUND OF THE INVENTION

1. Field of the Invention

The present invention relates to a compression gas puffer type circuit breaker and, in particular, relates to an improvement in the arrangement and cooling structure of a magnetic body for controlling an inter electrode transient recovery voltage which is provided in such a compression gas puffer type circuit breaker so as to reduce the interrupting duty thereof in the event of a short line fault.

2. Conventional Art

Due to an increase in voltage level and power transmission capacity of a power transmission system such as introduction of an UHV power transmission in association with recent increasing demand of electrical power, a current to be interrupted by a circuit breaker in an event of grounding fault in a power transmission system is continuously increasing. Further, as a result of the conditions imposed by the locations of such sub-stations and switching stations in these days, down sizing of the gas circuit breakers has become an indispensable technical tasks. In order to resolve such a technical task, an improvement in current interrupting performance of such circuit breakers is proposed to reduce current interruption points in the circuit breakers and to increase current interrupting capacity per one current interrupting point.

Under these circumstances, the increase of the power transmission capacity causes an increase in the current to be interrupted and in the variation rate of the interrupting current in the event of a short line fault, which also increases the rate of rise of transient recovery voltage in a circuit breaker, thereby an increase in current interrupting duty is required for the circuit breaker.

One solution for such problems is disclosed, for example, in JP-A-3-190028 in which the variation rate of the interrupting current is reduced with a provision of a magnetic body disposed coaxialy with a stationary arc contact of a compression gas puffer type circuit breaker, to thereby suppress the increase in the rate of rise of the transient recovery voltage in the circuit breaker.

Because the magnetic body is disposed in a manner so as to surround the stationary arc contact, in the event of a short line fault an interrupting current flows through the movable and stationary arc contacts via the current arc therebetween, the magnetic fluxes generated by the interrupting current crosslink the magnetic body and the self inductance of the magnetic body begins to increase immediately before the interrupting current reaches the zero point. As a result, the variation rate of the interrupting current is reduced and the rate of the rise of transient recovery voltage between electrodes of the circuit breaker is also reduced in proportion to the variation rate of the interrupting current, thereby the current interrupting capacity of the circuit breaking portion equivalently increases and the current interrupting performance of the circuit breaker is improved.

However, in the above explained prior art circuit breaker, the magnetic body is directly exposed to a heated gas which is exhaused at a high speed from an insulation nozzle and flows into a contact base surrounding the stationary arc contact. Further, when the magnetic body is excited by an interrupting current, the temperature of the magnetic body is raised because of heat generation by the magnetic body itself due to electric power losses such as hysteresis loss and eddy current loss. Still further, a current arc is generated at a top of the stationary arc contact which the magnetic body surrounds and the stationary arc contact is heated thereby, and the temperature of the magnetic body is further raised because of thermal conduction through the conductor constituting the stationary arc contact.

The magnetic body for controlling the transient recovery voltage is generally formed of amorphous or ultra fine crystalline soft magnetic materials such as ferrite and amorphous alloys having Curie temperatures Tc are at most about 570° C. and if the temperature of the magnetic body execeeds its Curie temperature, the magnetic body is completely demagnetized. Further, when the temperature of the magnetic body exceeds about 100° C., the saturation magnetic flux density of the magnetic body decreases and the magnetic coercive force increases, accordingly the amount of retainable magnetic flux in the magnetic body decreases and the electric power loss therein remarkably increases.

Therefore, with the conventional structure an extreme temperature rise of the magnetic body was unavoidable and an intended performance of the magnetic body could not be obtained because of the deterioration of the magnetic properties thereof.

Further, with the conventional structure the stationary arc contact only once passes through the magnetic body because of the structure thereof such that the number of effective magnetic flux linkages with the magnetic body is inherently limited. As a result, in order to permit a predetermined amount of magnetic fluxes to be accepted, it is indispensable to increase the volume of the magnetic body, thereby the electric power loss in the magnetic body increases and the size and weight increase of the magnetic body becomes unavoidable in accordance with the volume increase thereof.

SUMMARY OF THE INVENTION

An object of the present invention is to provide a compression gas puffer type circuit breaker in which the above conventional problems are resolved.

Another object of the present invention is to provide a compression gas puffer type circuit breaker in which the size of the magnetic body is reduced an the electric power loss therein is also reduced.

Still another object of the present invention is to provide a compression gas puffer type circuit breaker of which the current interrupting performance is improved by means of an effective cooling structure for the magnetic body.

In view of the above explained problems encountered in the conventional compression gas puffer type circuit breaker, the present invention is characterized, in that a detachable stationary arc contact is secured to a conductor which is electrically connected to one of the main bus conductors and a magnetic body is disposed around the conductor so as not to be directly exposed to a heated exhaust puffer gas from an insulator nozzle. Further, the present invention is characterized, in that a contact base for carrying a stationary main contact having a plurality of vent openings is provided and an insulator member is secured at a flange portion of the contact base provided at the downstream of the vent openings, the conductor securing the stationary arc contact is secured by the insulator member and the magnetic member is disposed downstream of the insulator member so that the insulator member functions as a partition for the magnetic body thereby the magnetic body is prevented from being directly exposed to the heated exhaust puffer gas from the insulator nozzle.

Further, the present invention is characterized, in that either an insulator cylinder or a metal cylinder having a plurality of openings at the wall thereof is provided which surounds the circumference of the magnetic body.

Still further, the present invention is characterized, in that the detachable stationary arc contact is secured to the conductor which is electrically connected to one of main bus conductors and the magnetic body is disposed around the conductor as well as a plurality of conductor rods are disposed around the magnetic body so as to constitute a round trip passage or one turn coil of an interrupting current around the magnetic body.

According to the present invention, an interrupting current induced in the event of a short line fault flows via a current arc generated between the movable arc contact and the stationary arc contact and the securing conductor for the stationary arc contact to the main bus conductor to which the securing conductor is electrically and mechanically connected. At this instance since the magnetic body is disposed around the securing conductor, the magnetic body is effectively excited by the interrupting current. As a result, the self inductance of the magnetic body begins to increase immediately before the current zero point of the interrupting current is reached and the variation rate of the interrupting current is reduced, thereby the rate of rise of transient recovery voltage between the electrodes of the circuit breaker is also reduced and the current interrupting performance of the circuit breaker is improved.

Further, in the present invention the insulator member is provided at the flange portion of the contact base located downstream of the plurality of vent openings formed on the cylindrical wall thereof, the securing conductor for the stationary arc contact is secured by the insulator member and further the magnetic body is disposed downstream the insulator member, therefore the insulator member functions as a partition for the magnetic body and prevents the magnetic body from being directly exposed to the heated exhaust puffer gas from the insulator nozzle, thereby an excessive temperature rise of the magnetic body is suppressed and the magnetic property deterioration of the magnetic body is prevented.

Further, the heat due to electrical power loss caused by the magnetic body itself during a current interruption is effectively released through the plurality of openings provided at the wall of either the insulator cylinder or the metal cylinder surrounding the magnetic body, thereby an excessive temperature rise of the magnetic body is suppressed.

Still further, in the present invention the magnetic body is disposed around the securing conductor for the stationary arc contact, and a plurality of conductor rods are disposed so as to surround the magnetic body and to constitute a round trip passage of an interrupting current around the magnetic body. Thereby cross linking magnetic flux of the magnetic body amounts to the sum of the magnetic flux caused by the interrupting current flowing through the securing conductor and cross-linking with the magnetic body and the magnetic flux caused by branching interrupting currents flowing through the respective conductor rods and cross-linking with the magnetic body. Accordingly, the amount of magnetic flux is increased by the branching interrupting currents flowing through the respective conductor rods in comparison with the conventional structure. Thereby an acceptable amount of magnetic flux required of a magnetic body and the required self inductance thereof are realized by a magnetic body of a smaller volume than that of the conventional one, thereby the size and weight of the magnetic body are reduced and the electrical power loss therein can be also reduced.

DETAILED DESCRIPTION OF THE EMBODIMENTS

The present invention is explained with reference to the embodiments shown in FIGS. 1 through 7.

Figure 1:
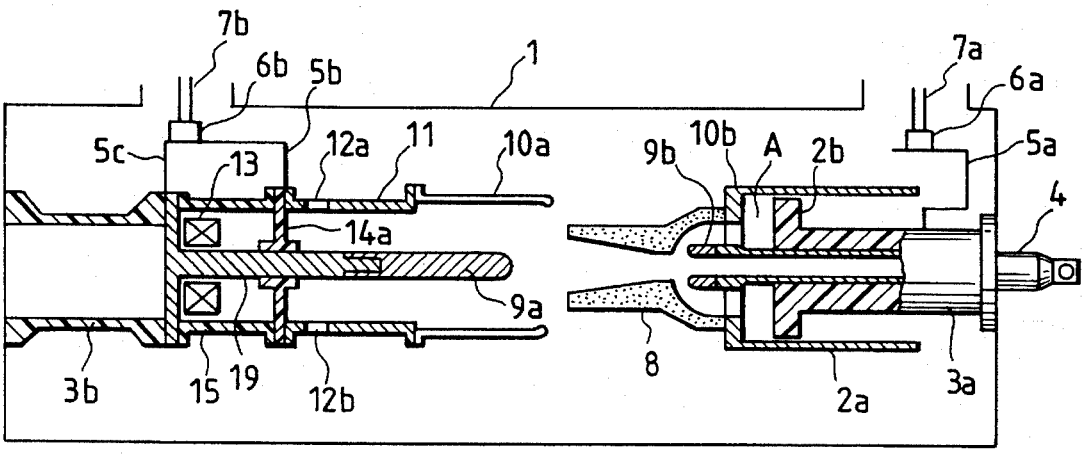
FIG. 1 is a schematic cross sectional view of one embodiment of the compression gas puffer type circuit breakers, in particular illustrating an arrangement of a magnetic body, according to the present invention.

In the compression gas puffer type circuit breaker shown in FIG. 1, a puffer action is induced by a combination of a puffer cylinder **2*a* integrating an insulator nozzle 8, a puffer shaft 4 and a movable arc contact 9*b* and a stationary piston 2*b* through actuation of the puffer shaft 4 coupled with an actuation mechanism (not shown). An arc extinguishing gas compressed and puffed by means of the puffer action is blasted to a current arc generated between the movable arc contact 9*b* and a stationary arc contact 9*a*, which is disposed on substantially the same axis of the movable arc contact 9*b* so as to be engagable therewith, to interrupt the current arc, and the blasting arc extinguishing gas is heated to a high temperature, for example up to 5000° K, by the current arc and is exhausted from the insulator nozzle 8 at least toward a contact base 11 carrying a main stationary contact 10*a***.

The movable arc contact **9*b* is electrically connected to one of main bus conductor 7*a* via a conductor 5*a* and a connecting member 6*a*, and the stationary arc contact 9*a* is also electrically connected to the other main bus conductor 7*b* via a conductor 5*c* and a connecting member 6*b*. Further, a movable main contact 10*b* carried on the puffer cylinder 2*a* is disposed so as to be engagable with the stationary main contact 10*a* carried on the contact base 11**.

Further, in order to facilitate exchange work and to improve maintenance efficiency the stationary arc contact **9*a* is detachably disposed and a magnetic body 13 is disposed around a securing conductor 19 which mechanically secures the stationary arc contact 9*a* and electrically connects the same to the main bus conductor 7*b*. Further, the securing conductor 19 is fixedly supported by an insulator member 14***a* secured on a flange portion of the contact base 11 provided at the downstream of a plurality of vent openings 12*a* and 12*b* formed on the cylindrical wall of the contact base 11 so as to exhaust the heated exhaust gas which flows out from the insulator nozzle 8 and flows into the contact base 11, and by an insulator cylinder 3*b* secured on a grounded tank 1. Thereby the securing conductor 19 and the contact base 11 are electrically insulated from the grounded tank 1, and the magnetic body 13 is disposed downstream of the insulator member 14*a*. Further, a cylindrical intermediate member 15 is further provided which is secured respectively to the securing conductor 19 and the insulator member 14*a* and is disposed so as to surround the magnetic body 13. The cylindrical intermediate member 15 can be made either of an insulating material or a metal conductor, and even when cylindrical intermediate member 15 is made of a metal conductor, the cylindrical intermediate member 15 is insulated from the contact base 11 via the insulator member 14*a*.

In the event of a short line fault, an interrupting current flows through the securing conductor 19 via a current arc generated between the movable arc contact 9*b* and the stationary arc contact 9*a* and the magnetic body 13 is excited by the magnetic fluxes induced by the interrupting current flowing through the securing conductor 19. At this instance by means of the partitioning function of the insulator member 14*a* provided at the contact base 11, the magnetic body 13 is protected from being exposed to the heated exhausting gas flowing out from the insulator nozzle 8, thereby the performance deterioration of the magnetic body 13 due to excessive temperature rise thereof is prevented and the magnetic body 13 can be used semi-permanently. Further, since a normal supply current flows from one main bus conductor 7*a* to the other main bus conductor 7*b* via the engagable movable and stationary contacts 10*b* and 10*a*, the contact base 11, a conductor 5*b* connected to the contact base 11 and the connecting member 6*b*, no significant magnetic influence by the normal supply current is effected on the magnetic body 13.

Figure 2:
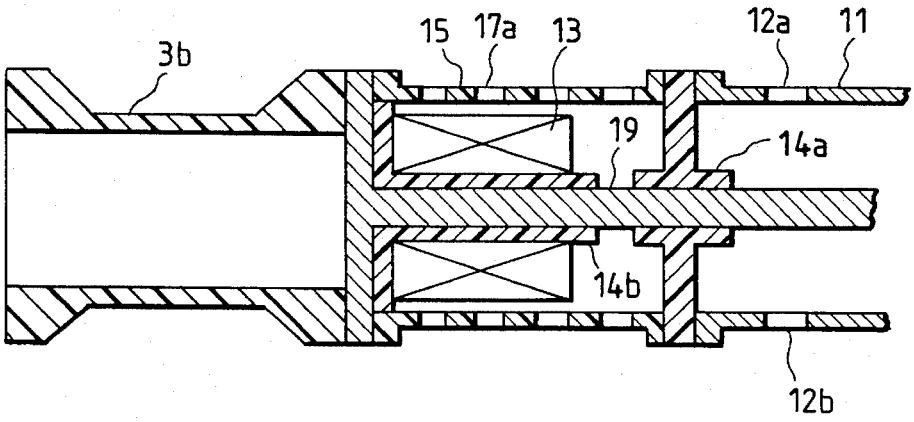
FIG. 2 is a partial sectional view of the embodiment shown in FIG. 1, in particular illustrating one of the cooling structures for the magnetic body.

FIG. 2 is a cross sectional view showing one of cooling structures for the magnetic body 13 in the embodiment shown in FIG. 1.

In FIG. 2, on the side wall of the cylindrical intermediate member 15 which surrounds the magnetic body 13 a plurality of openings 17*a* are provided. Thereby the heat generated in the magnetic body 13 due to power loss therein during a current interruption is effectively released through the openings 17*a* and the excessive temperature rise of the magnetic body 13 is prevented. Further, because of excessive heating of the top end of the stationary arc contact 9*a* due to the current arc generated thereat the magnetic body 13 is further heated by thermal conduction via the securing conductor 19 for the stationary arc conductor 9*a*. Therefore, in order to prevent such excess heating of the magnetic body, a further insulator member 14*b* which also serves as an electrical insulator is provided between the securing conductor 19 and the magnetic body 13.

Figure 3:
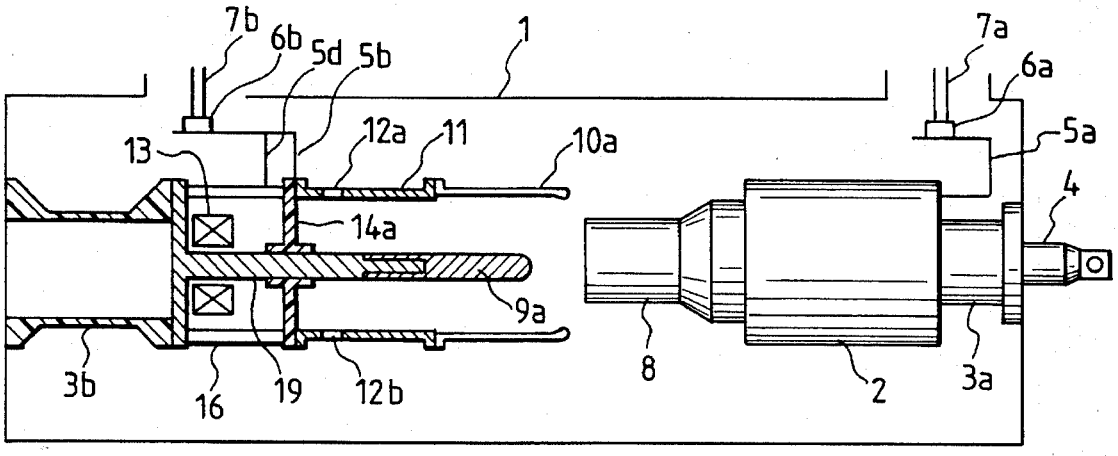
FIG. 3 is a schematic partial cross sectional view of another embodiment of the compression gas puffer type circuit breaker, in particular illustrating another arrangement of a magnetic body, according to the present invention.

FIG. 3 is a diagram of another embodiment, in particular illustrating another arrangement of the magnetic body, of the compression gas puffer type circuit breakers according to the present invention.

In FIG. 3, a plurality of conductor rods 16 are provided so as to surround the magnetic body 13, and the conductor rods are electrically and mechanically connected to a flange portion of the securing conductor 19 which is surrounded by the magnetic body 13 at their one ends and at their other ends thereof are secured via the insulator member 14*a* secured to the flange portion of the contact base 11. Thereby a round trip passage of an interrupting current surrounding the magnetic body is formed by the combination of the securing conductor 19 and the plurality of conductor rods 16. The other ends of the conductor rods 16 at the side of the insulator member 14*a* are connected to the other main bus conductor 7*b* via a conductor 5*d*. In the present embodiment, an interrupting current flowing through the securing conductor 19 branches respectively, through the plurality of conductor rods 16 and then flows into the other main bus conductor 7*b* via the conductor 5*d*. For this reason, both magnetic flux components generated by the interrupting current flowing through the securing conductor 19 and by the branching interrupting currents flowing through the respective conductor rods 16 interlink with the magnetic body 13, thereby the number of magnetic flux linkages is substantially increased. As a result, the size of the magnetic body 13, which is required to have a predetermined amount of acceptable magnetic flux and self inductance, is reduced and reduction of electrical power loss therein is achieved. Further, since the plurality of conductor rods 16 are disposed so as to surround the magnetic body 13 and a plurality of gaps are formed between the conductor rods 16, the heat generated at the magnetic body 13 is effectively released via the gaps, thereby an excessive temperature rise of the magnetic body 13 is suppressed. Further, a normal supply current flows through the contact base 11 to which the main stationary contact 10*a* is electrically and mechanically connected, and via the conductor 5*b* to the other main bus conductor 7*b*, thereby no significant magnetic influence by the normal supply current is effected on the magnetic body 13.

Figure 4:
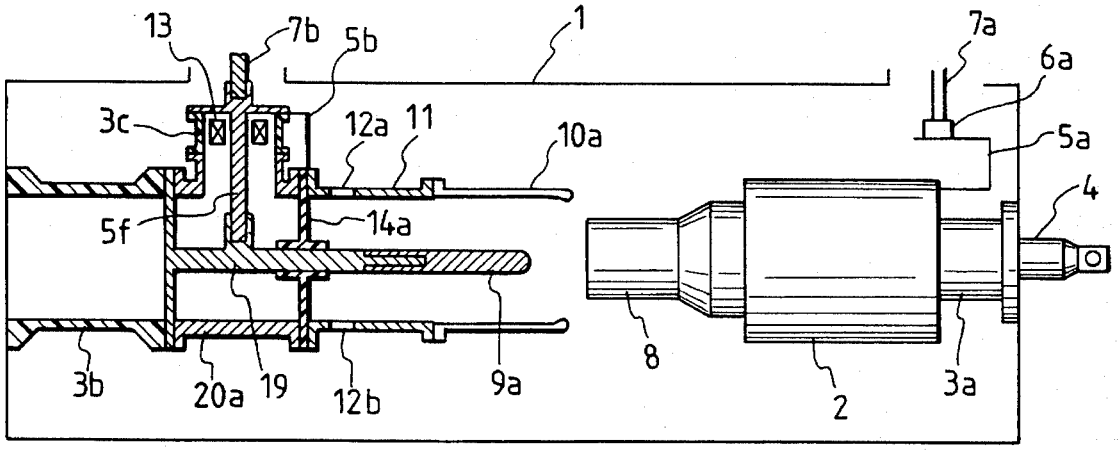
FIG. 4 is a schematic partial cross sectional view of still another embodiment of the compression gas puffer type circuit breaker, in particular illustrating still another arrangement of a magnetic body, according to the present invention.

FIG. 4 is a diagram of still another embodiment, in particular illustrating still another arrangement of the magnetic body of the compression gas puffer type circuit breakers according to the present invention.

In FIG. 4, the securing conductor 19 securing the detachable stationary arc contact 9*a* is secured by the insulator cylinder 3*b* secured to the grounding tank 1, the insulator member 14*a* is secured at the flange portion of the contact base 11 located downstream of the vent openings 12*a* and 12*b* formed on the wall thereof and the securing conductor 19 is electrically insulated from the contact base 11 by the insulator member 14*a*. Further a metal cylinder 20*a* is secured between the insulator member 14*a* and the flange portion of the securing conductor 19 and is electrically insulated from the contact base 11 by the insulator member 14*a*. Further yet, a connecting conductor 5*f* is provided which permits detachable connection between the securing conductor 19 and the other main bus conductor 7*b* and the magnetic body 13 is disposed so as to surround the connecting conductor 5*f*. An further insulator cylinder 3*c* is secured between a flanged opening of the metal cylinder 20*a* and a flange portion of the connecting conductor 5*f* so as to surround the magnetic body 13. The connecting conductor 5*f* is electrically connected to the other main bus conductor 7*b* at the side of the flange portion, and the contact base 11 is electrically connected to the other main bus conductor 7*b* via the conductor 5*b*.

Accordingly, with the present embodiment, the magnetic body 13 is protected from being exposed to the heated (hot) exhaust gas from the insulator nozzle 8 and the magnetic performance deterioration of the magnetic body 13 due to the heating thereof is prevented. Further, since a normal supply current primarily flows via the main stationary contact 10*a*, the contact base 11 and the conductor 5*b* to the other main bus conductor 7*b*, no significant magnetic influence by the normal supply current is effected on the magnetic body 13. Further, in an event of short line fault an interrupting current flows through the connecting conductor 5*f* electrically connected to the securing conductor 19 for the stationary arc contact 9*a* such that the magnetic body 13 is effectively excited by the interrupting current flowing through the connecting conductor 5*f*.

Figure 5:
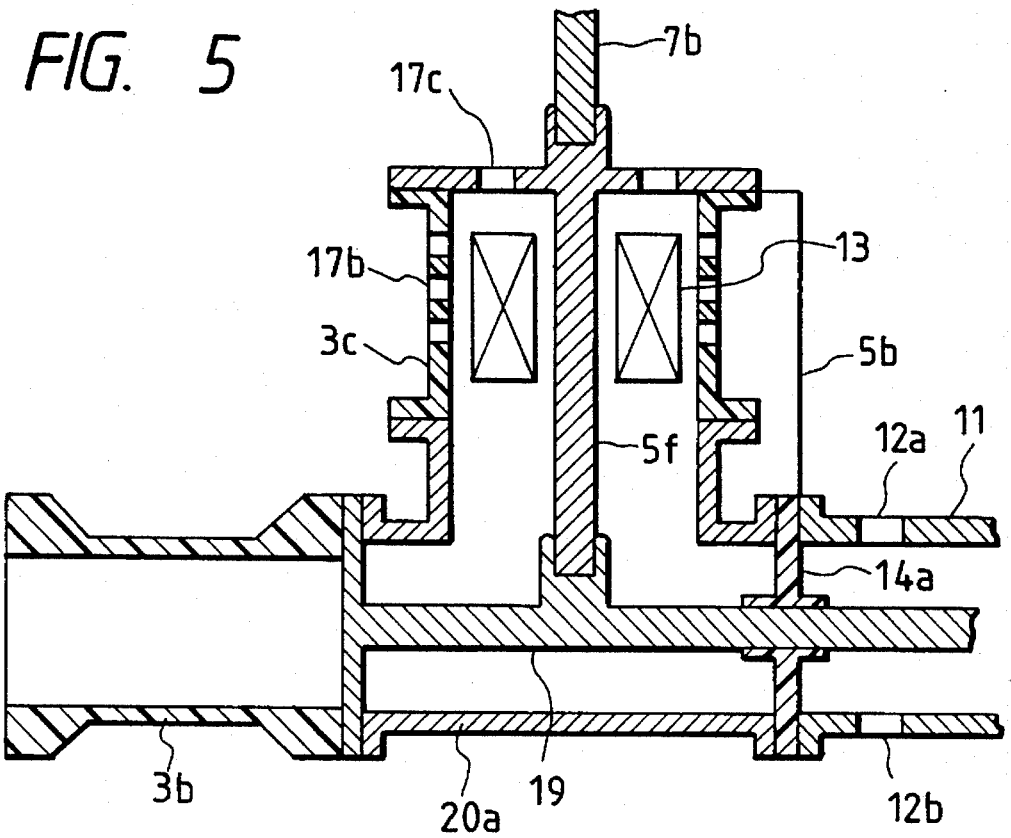
FIG. 5 is a partial cross sectional view of the embodiment shown in FIG. 4, in particular illustrating another cooling structure for the magnetic body.

FIG. 5 is a cross sectional view of one of the cooling structures for the magnetic body 13 in the embodiment shown in FIG. 4.

In FIG. 5, on the wall of the insulator cylinder 3*c* which surrounds the magnetic body 13 and which electrically insulates the metal cylinder 20*a* from the flange portion of the connecting conductor 5*f*, a plurality of openings 17*b* are provided. At the flange portion of the connecting conductor 5*f* to which the other main bus conductor 7*b* is connected, a plurality of openings 17*c* are provided. Through these openings 17*b* and 17*c* the heat release of the magnetic body 13 is effectively accelerated and an excessive temperature rise of the magnetic body 13 is prevented. In particular, since the gas heated by the magnetic body 13 rises upward, the heat release is effectively accelerated with the provision of the openings 17*c*. Further, in the present embodiment the magnetic body 13 is disposed in a thermally symmetric condition no distorted heat stress is applied to the magnetic body 13.

Figure 6:
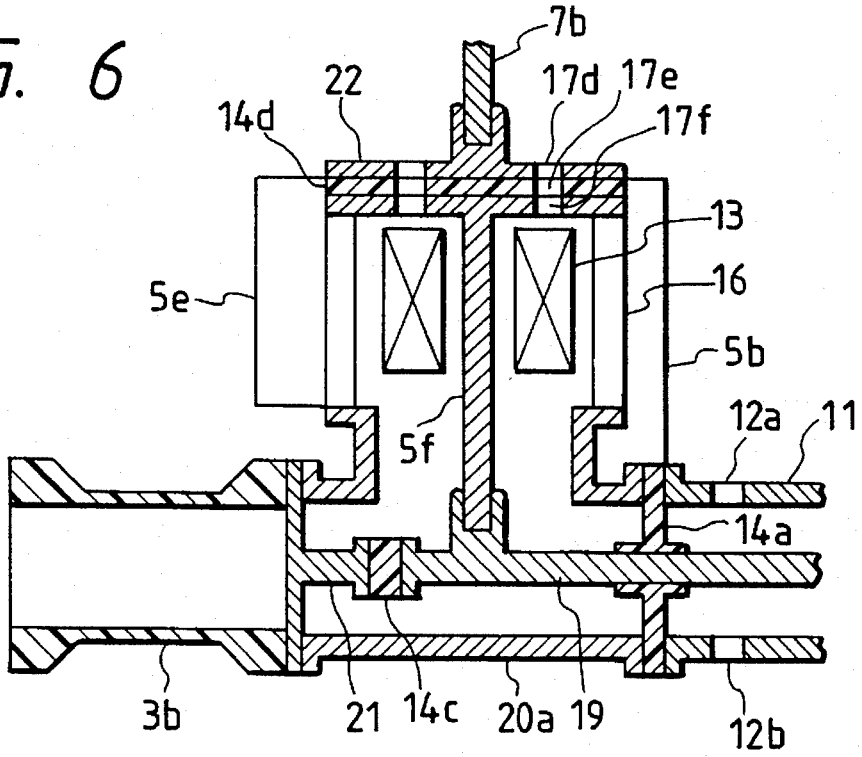
FIG. 6 is a schematic partial cross sectional view of a further embodiment of the compression gas puffer type circuit breaker, in particular illustrating a further arrangement of a magnetic body, according to the present invention.

FIG. 6 is a constitutional diagram of a further embodiment, in particular illustrating further arrangement of the magnetic body, of the compression gas puffer type circuit breakers according to the present invention.

In FIG. 6, like in the FIG. 4 embodiment the insulator member 14*a* is secured at the flange portion of the contact base 11 located downstream of the vent openings 12*a* and 12*b* formed on the wall thereof. Further, between the securing conductor 19 for the stationary arc contact 9*a* and a supporting conductor 21 secured on the insulator cylinder 3*b*, an insulator block 14*c* is provided with which the securing conductor 19 is firmly coupled with the supporting conductor 21 while maintaining an electrical insulation therebetween. Further the magnetic body 13 is disposed around the connecting conductor 5*f* and is detachably connected to the securing conductor 19. The metal cylinder 20*a* is disposed between the flange portion of the supporting conductor 21 and the insulator member 14*a* secured to the contact base 11 and secured thereto. A plurality of conductor rods 16 are disposed between a flanged opening of the metal cylinder 20*a* and the flange portion of the connecting conductor 5*f* so as to surround the magnetic body 13 and be electrically and mechanically connected thereto, thereby like the FIG. 3 embodiment, a round trip passage of an interrupting current around the magnetic body 13 is constituted by the combination of the connecting conductor 5*f* and the plurality of conductor rods 16.

Further, the contact base 11 is electrically connected to the other main bus conductor 7*b* via the conductor 5*b*. The connecting conductor 5*f* is electrically insulated from the other main bus conductor 7*b* through the provision of a further insulator member 14*d* disposed between the flange portion of the connecting conductor 5*f* and a flange portion of the other main bus conductor 7*b*. The conductor rods 16 are secured at their one ends thereof to the flange portion for the opening of the metal cylinder 20*a* and are electrically connected to the other main bus conductor 7*b* via a conductor 5*e*. Accordingly, when an interrupting current flows through the connecting conductor 5*f*, the magnetic body 13 is excited by both magnetic flux components induced by the interrupting current flowing through the connecting conductor 5*f* and the branching interrupting currents flowing through the respective conductor rods 16, which contributes to a substantial increase in the number of magnetic flux crosslinkages, thereby the size of the magnetic body 13 is reduced and thus electrical power loss therein is also reduced. Further, the conductor rods 16 are disposed so as to surround the magnetic body 13 and gaps are formed between the respective conductor rods 16 such that the heat generated at the magnetic body 13 is effectively released via the gaps thus formed. As a result, an excessive temperature rise of the magnetic body 13 is suppressed. Still further, the gas surrounding the magnetic body is heated because of the heat generated by the magnetic body 13 itself during a current interruption, and rises upward. Through the provision of the openings 17*f* formed at the flange portion of the connecting conductor 5*f*, openings 17*e* formed at the insulator member 14*d* and openings 17*d* formed at a metal flange 22 detachably connected to the other main bus conductor 7*b* of which respective openings 17*f*, 17*e* and 17*d* are registered to permit gas flow, the heat of the magnetic body 13 is effectively released therethrough. Further, since a normal supply current primarily flows via the conductor 5*b* connected to the contact base 11 to the other main bus conductor 7*b*, no significant magnetic influence by the normal supply current is effected on the magnetic body 13. Still further, an interrupting current flowing through the connecting conductor 5*f* branches into the conductor rods 16 connected thereto and then flows to the other main bus conductor 7*b* via the conductor 5*e* connected to the respective conductor rods 16, thereby the magnetic body 13 is also effectively excited by the branching interrupting currents.

Figure 7:
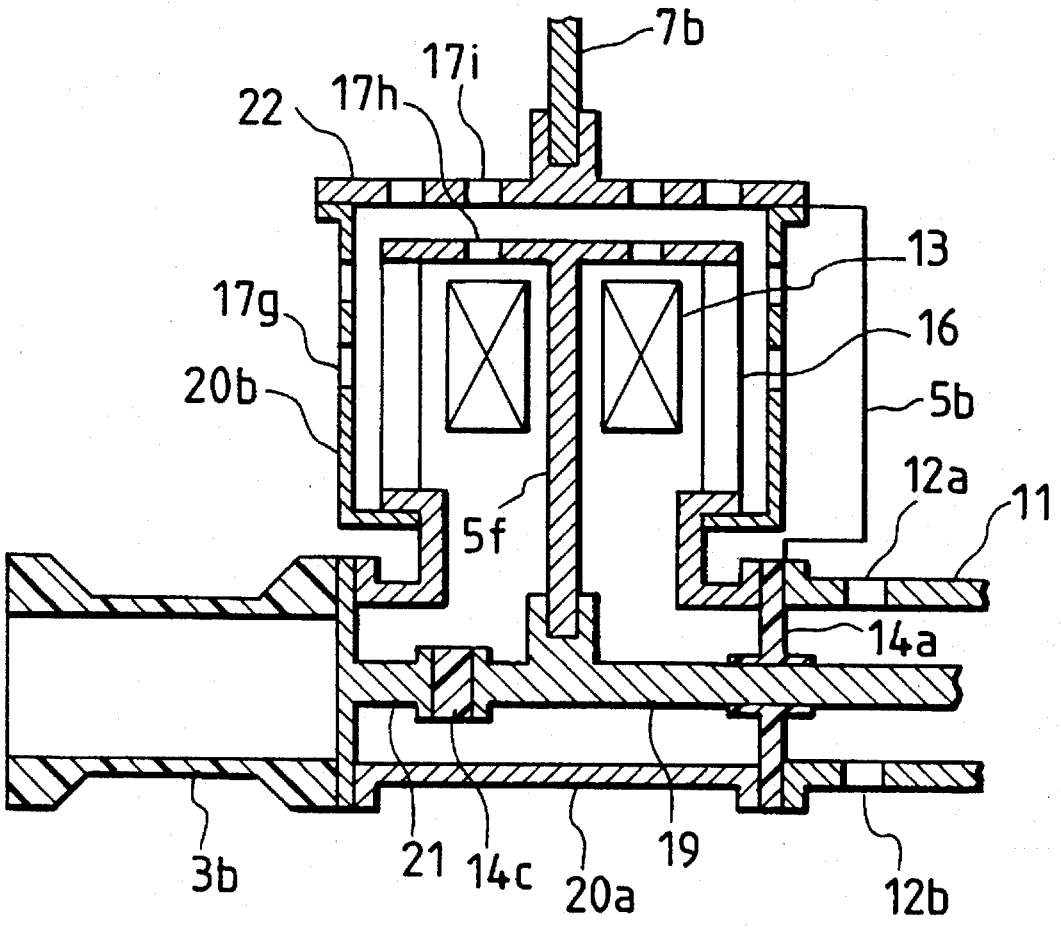
FIG. 7 is a partial cross sectional view of one modification of the embodiment shown in FIG. 6, in particular illustrating the arrangement of the magnetic body.

FIG. 7 is a constitutional diagram of a still further embodiment, in particular illustrating a still further arrangement of the magnetic body, of the compression gas puffer type circuit breakers according to the present invention.

In FIG. 7, the conductor 5*e* connecting and securing both the other main bus conductor 7*b* and the conductor rods 16 of the FIG. 6 embodiment are replaced by a metal cylinder 20*b* which is disposed on the common axis as the magnetic body 13 so as to surround the same. In the present embodiment, since the branching interrupting currents in the respective conductor rods 16 flow via the symmetrical metal cylinder 20*b* to the other main bus conductor 7*b*, the magnetic influence of the interrupting current flowing through the conductor 5*e* is completely eliminated with the introduction of the symmetric metal cylinder 20*b*. Further, like the FIG. 6 embodiment since a normal supply current flows to the other main bus conductor 7*b* via the contact base 11 and the conductor 5*b* is electrically connected to the metal flange 22 to which the other main bus conductor 7*b* is detachably connected, no significant magnetic influence by the normal supply current is effected on the magnetic body 13. Still further, through the provision of openings 17*h* formed on the flange portion of the connecting conductor 5*f*, openings 17*g* formed on the wall of the metal cylinder 20*b* and openings 17*i* formed at the metal flange 22 the heat generated at the magnetic body is effectively released and the magnetic property deterioration of the magnetic body 13 due to excessive temperature rise thereof is prevented.

In the above embodiments, only the magnetic body 13 is provided around the conductor member connecting the stationary arc contact 9*a* and the other main bus conductor 7*b*, however a capacitor can be provided in parallel with the magnetic body 13 through which the rate of rise of the transient recovery voltage during a current interrupting operation is further suppressed.

According to the present invention, during the course of a fault current interrupting operation in the compression gas puffer type circuit breaker, the magnetic body is protected from being exposed to the heated (hot) exhaust gas from the insulator nozzle. Further, with the effective cooling structures for the magnetic body, the magnetic performance deterioration of the magnetic body due to excessive temperature rise thereof is prevented and the magnetic body can be used semi-permanently.

Further, through the formation of the round trip passage of an interrupting current with regard to the magnetic body, the number of effective magnetic flux cross linkages with the magnetic body increases thereby, the size of the magnetic body is reduced and the electrical loss in the magnetic body is also reduced as well, which contributes the total size reduction of the compression gas puffer type circuit breaker.

We claim:

1. A compression gas puffer type circuit breaker comprising:

a ground tank containing an arc extinguishing gas;

a pair of movable and stationary main contacts which are disposed in engagable and disengagable manner in said grounded tank;

a puffer cylinder carrying said movable main contact;

an insulator nozzle carried by said puffer cylinder;

a puffer shaft mechanically connected to said puffer cylinder and mechanically coupled to an external operating mechanism for said puffer cylinder;

a stationary puffer piston disposed within said puffer cylinder so as to constitute a puffer chamber in said puffer cylinder;

a movable arc contact carried at one end of said puffer shaft;

a stationary arc contact which is disposed engagably and disengagably with said movable arc contact through said insulator nozzle;

a cylindrical contact base carrying at one end thereof said stationary main contact for locating in position;

a first conductor means connecting said stationary main contact to a first main bus conductor via said cylindrical contact base;

a second conductor means connecting said stationary arc contact to the first main bus conductor;

a magnetic body surrounding said second conductor means;

an insulator plate secured at the other end of said cylindrical contact base for closing the same while permitting said second conductor means passing therethrough, said insulator plate preventing said magnetic body from being exposed to heated puffer gas generated when said movable and stationary arc contacts are separated;

a plurality of openings formed at the cylinder wall of said cylindrical contact base near said insulator plate for venting the heated puffer gas;

an insulator cylinder for insulatedly supporting said cylindrical contact base via said insulator plate and said stationary arc contact in said grounded tank; and an intermediate member disposed between said insulator plate and said insulator cylinder and surrounding at least a part of said second conductor means.

2. A compression gas puffer type circuit breaker according to claim 1, wherein said second conductor means includes a first rod conductor for supporting said stationary arc contact at one end thereof while permitting replacement thereof, said first rod conductor is provided with a flange at the other end thereof and is supported by said insulator plate as well as by said insulator cylinder via the flange thereof, said magnetic body is disposed behind said insulator plate and around said first rod conductor, and said intermediate member is an insulator cylinder with a plurality of venting openings at the wall thereof surrounding said magnetic body for protecting said magnetic body from the heated puffer gas vented from said plurality of openings formed at the wall of said cylindrical contact base.

3. A compression gas puffer type circuit breaker according to claim 2, further comprising a flanged insulator sleeve disposed between said magnetic body and said first conductor rod.

4. A compression gas puffer type circuit breaker according to claim 1, wherein said second conductor means includes a first rod conductor for supporting said stationary arc contact at one end thereof while permitting replacement thereof, said first rod conductor is provided with a flange at the other end thereof and is supported by said insulator plate as well as by said insulator cylinder via the flange thereof, said magnetic body is disposed behind said insulator plate and around said first rod conductor, and said intermediate member is a metal cylinder with a plurality of venting openings at the wall thereof surrounding said magnetic body for protecting the same from the heated puffer gas vented from said plurality of openings formed at the wall of said cylindrical contact base and forming a part of said second conductor means.

5. A compression gas puffer type circuit breaker according to claim 4, further comprising a flanged insulator sleeve disposed between said magnetic body and said first conductor rod.

6. A compression gas puffer type circuit breaker according to claim 1, wherein said second conductor means includes a first rod conductor for supporting said stationary arc contact at one end thereof while permitting replacement thereof, said first rod conductor is provided with a flange at the other end thereof and is supported by said insulator plate and by said insulator cylinder via the flange thereof, said magnetic body is disposed behind said insulator plate and around said first rod conductor, and said intermediate member constitutes a plurality of second conductor rods forming a part of said second conductor means.

7. A compression gas puffer type circuit breaker according to claim 1, wherein said second conductor means includes a first rod conductor for supporting said stationary arc contact at one end thereof while permitting replacement thereof and a third rod conductor extending substantially perpendicular from said first rod conductor and connected thereto at one end thereof, said first rod conductor is provided with a flange at the other end thereof and is supported by said insulator plate and by said insulator cylinder via said flange thereof and said third rod conductor is provided with a flange having a plurality of vent openings at the other end thereof through which said third rod conductor is connected to the first main bus conductor, said intermediate member is a metal cylinder having a flanged opening at the longitudinal midway thereof, said third rod conductor is disposed so as to extend through the flanged opening of said metal cylinder, said magnetic body is disposed around said third rod conductor and a further insulator cylinder having a plurality of vent openings at the wall thereof is disposed between the flange of said third rod conductor and the flanged opening of said metal cylinder so as to surround said magnetic body for protecting the same from the heated puffer gas vented from the plurality of openings formed at the wall of said cylindrical contact base.

8. A compression gas puffer type circuit breaker according to claim 1, wherein said second conductor means includes a first rod conductor for supporting said stationary arc contact at one end thereof while permitting replacement thereof and a third rod conductor extending substantially perpendicular from said first rod conductor and connected thereto at one end thereof, said first rod conductor is supported by said insulator plate and by said insulator cylinder via an insulator block and a flanged rod member and said third rod conductor is provided with a flange having a plurality of vent openings at the other end thereof, said intermediate member is a metal cylinder having a flanged opening at the longitudinal midway thereof, said third rod conductor is disposed so as to extend through the flanged opening of said metal cylinder, said magnetic body is disposed around said third rod conductor and a plurality of fourth rod conductors are disposed between the flange of said third rod conductor and the flanged opening of said metal cylinder so as to surround said magnetic body, said plurality of fourth rod conductors constitute a part of the second conductor means.

9. A compression gas puffer type circuit breaker according to claim 8, further comprising a further metal cylinder having a plurality of vent opening at the wall thereof disposed concentrically with said third rod conductor and surrounding said plurality of fourth rod conductors, one end of said further metal cylinder is connected to the flanged opening of said metal cylinder and the other end of said further metal cylinder is connected to a flange member for the first main bus conductor, said further metal cylinder constitutes also a part of said second conductor means and protects said magnetic body from being exposed to the heated puffer gas vented from the openings formed at the wall of said cylindrical contact base.

* * * * *